US006152246A

United States Patent [19]

King et al.

[11] Patent Number: 6,152,246

[45] Date of Patent: Nov. 28, 2000

[54] METHOD OF AND SYSTEM FOR MONITORING DRILLING PARAMETERS

[75] Inventors: Charles H. King; Mitchell D. Pinckard; Donald P. Sparling; Arno Op De Weegh, all of Houston, Tex.

[73] Assignee: Noble Drilling Services, Inc., Houston, Tex.

[21] Appl. No.: 09/204,384

[22] Filed: Dec. 2, 1998

[51] Int. Cl.[7] ..... E21B 44/00

[52] U.S. Cl. ..... 175/26; 175/27; 175/38

[58] Field of Search ..... 175/24, 26, 27, 175/38, 40, 48, 50, 61

[56] References Cited

U.S. PATENT DOCUMENTS

| | | | |
|---|---|---|---|
| 3,802,259 | 4/1974 | Eckels | 73/153 |
| 4,662,608 | 5/1987 | Ball | 254/273 |
| 4,876,886 | 10/1989 | Bible et al. | 73/151.5 |
| 5,163,521 | 11/1992 | Pustanyk et al. | 175/40 |
| 5,842,149 | 11/1998 | Harrell et al. | 702/9 |
| 6,021,377 | 2/2000 | Dubinsky et al. | 702/9 |

OTHER PUBLICATIONS

M/D Totco Instrumentation™, *Total Smart Drilling*, "VIP+ For Windows".

M/D Totco Instrumentation™, *Total System 4 Smart Drilling*"The New Standard in Rigsite Monitoring and Analysis".

Apr. 1986, J.J. Chevallier, F.P. Quetier, D.W. Marshall, "Technical Drilling Data Acquisition and Processing With an Integrated Computer System", SRE Drilling Engineering, pp. 153–162.

1987, B. Peltier, *SPE/IADC* Drilling Conference, New Orleans, March "Computer Monitoring of Surface Parameters While Tripping", pp. 73–80.

1987, B. Peltier, 1987 SPE/IADC Drilling Conference held in New Orleans, LA, March, "Computer Monitoring of Surface Parameters While Tripping", pp. 1–2.

Apr. 1986, J.J. Chevallier, F.P. Quetier, D.W. Marshall, *SPDE* "Technical Drilling Data Acquisition and Processing With an Integrated Computer System", pp. 1–2.

*Primary Examiner*—Roger Schoeppel

*Attorney, Agent, or Firm*—Pillsbury Madison & Sutro, LLP

[57] ABSTRACT

A system includes a database that is adapted to store substantially continuously measured or calculated drilling parameters. At least one computer can access the database to display simultaneous user configurable graphical representations of selected drilling parameters. A user can observe multiple parameters graphically in real time.

25 Claims, 11 Drawing Sheets

METHOD OF AND SYSTEM FOR MONITORING DRILLING PARAMETERS

FIELD OF THE INVENTION

The present invention relates generally to earth boring and drilling, and more particularly to a method of and system for monitoring drilling parameters in real time.

DESCRIPTION OF THE PRIOR ART

The overall management of drilling operations is better described as an experiential based art than as a rigidly defined science. Although many resources, both financial and human, have been devoted to investigating and describing the drilling process, there is no set of laws that describe, in all cases, the causal relationship between action and response. Successful management of the drilling process is much more often the result of experienced individuals who can recognize patterns emerging from the multitude of data sources available on a drilling rig, and respond appropriately so as to address the true root of an observed problem.

Currently, otherwise qualified drilling supervisors are required to gather data—often after the fact—from multiple sources, each presented in a more or less unique manner, and to compile the data into a format that not only keys the individual's pattern recognition ability, but also is in a sufficiently clear and logical format as to allow its explanation to his superiors for the purpose of gaining approval to pursue a particular course of action. Additionally, the majority of the data gathering functions on board a modern drilling unit are structured so as to be of most utility to office based geoscientists and/or engineers as opposed to the man on site.

There is a need for a data gathering and analysis tool that is available to on-site drilling supervisors and other personnel. Such a tool needs to provide real time information so that the drilling supervisor or other user can observe changes as they occur. Additionally, such a tool needs to provide complete archiving of data in a secure manner for future analysis. The tool also needs to be configurable so that different data can be observed simultaneously or in juxtaposition with one another in either a depth or time correlated manner.

The ability to monitor and observe changes that might be the result of changing operating conditions can aid the decision making process. For example, in directional drilling, it is common to observe a change in the directional response of an individual bottom hole assembly as a result of a change in the operating parameters such as weight on bit or rotary speed. The ability to accurately monitor and display these operating parameters against the assumed output of well bore inclination and direction can allow the drilling supervisor to minimize the cost of the well by minimizing the number of tool runs, or by ensuring that the bottom hole target is intercepted by the well bore on the first attempt. Other information provided in real time might be the correlation of background gas and the mud returns versus rate of penetration, or a correlation of swabbing tendency versus the speed at which the drill string is pulled out of the hole.

Prior to spudding a new well, it is typical that the drilling team would have at least a rudimentary understanding of the major geologic features that are expected to be encountered. Examples might be the depth of various geologic faults, transition from normal to geopressure, depths of major lithological changes, and depths of accumulation of hydrocarbons. The ability to plot data such as rate of penetration, mud gasses, dexponents, and drag in a depth-correlated manner would allow the drilling supervisor to identify anomalies that might imply changes in geologic formation. This ability would be critical to making successful operational decisions, in which planned operations must be reconciled with the actual behavior of the well. The ability to depth and/or time correlate drilling parameters, such as overpull, pipe velocity, position of bottom hole assembly (BHA) components and/or torque may provide insight into aberrations in well bore trajectory and/or stability that might need to be addressed to avoid future trouble.

SUMMARY OF THE INVENTION

The system of the present invention includes a database that is adapted to store substantially continuously measured or calculated drilling parameters. At least one computer can access the database to display simultaneous graphical representations of selected drilling parameters. The system of the present invention enables a user to observe multiple parameters in real time.

According to the present invention, a user is prompted to select a display screen from a list that preferably includes a pre-developed screen choice, a custom screen choice, and a standard screen choice. Each of the screens is adapted to display simultaneous real time graphical representations of a set of drilling parameters. If the user selects the custom screen choice, the system displays a list of drilling parameters and prompts the user to select a set of drilling parameters from the list of drilling parameters. After the user has selected the set of drilling parameters, the system prompts the user to configure the display screen. The system then prompts the user to save the screen as a pre-developed screen.

If the user selects the pre-developed screen choice, the system displays a list of screens the user has developed. Similarly, if the user selects the standard screen choice, the system displays a list of standard screens.

After the user has built a custom screen or selected a standard screen or a pre-developed screen, the system prompts the user to enable operating limit alarms for a set of drilling parameters. The user may set upper or lower operating limits for various parameters, or the system may use default operating limits. If the user enables the operating limit alarms, the system monitors the set of drilling parameters for operating limit alarm conditions and produces an alarm whenever a parameter is outside the set limits.

In addition to operating limit alarms, the system prompts the user to enable drilling event alarms. The occurrence of a drilling event is indicated by a signature, which is a combination of trends in values for certain parameters. If the user enables drilling event alarms, the system monitors certain of the drilling parameters for an occurrence of a drilling event signature. Upon detection of a signature, the system produces an alarm.

DESCRIPTION OF THE PREFERRED EMBODIMENT

Figure 1:
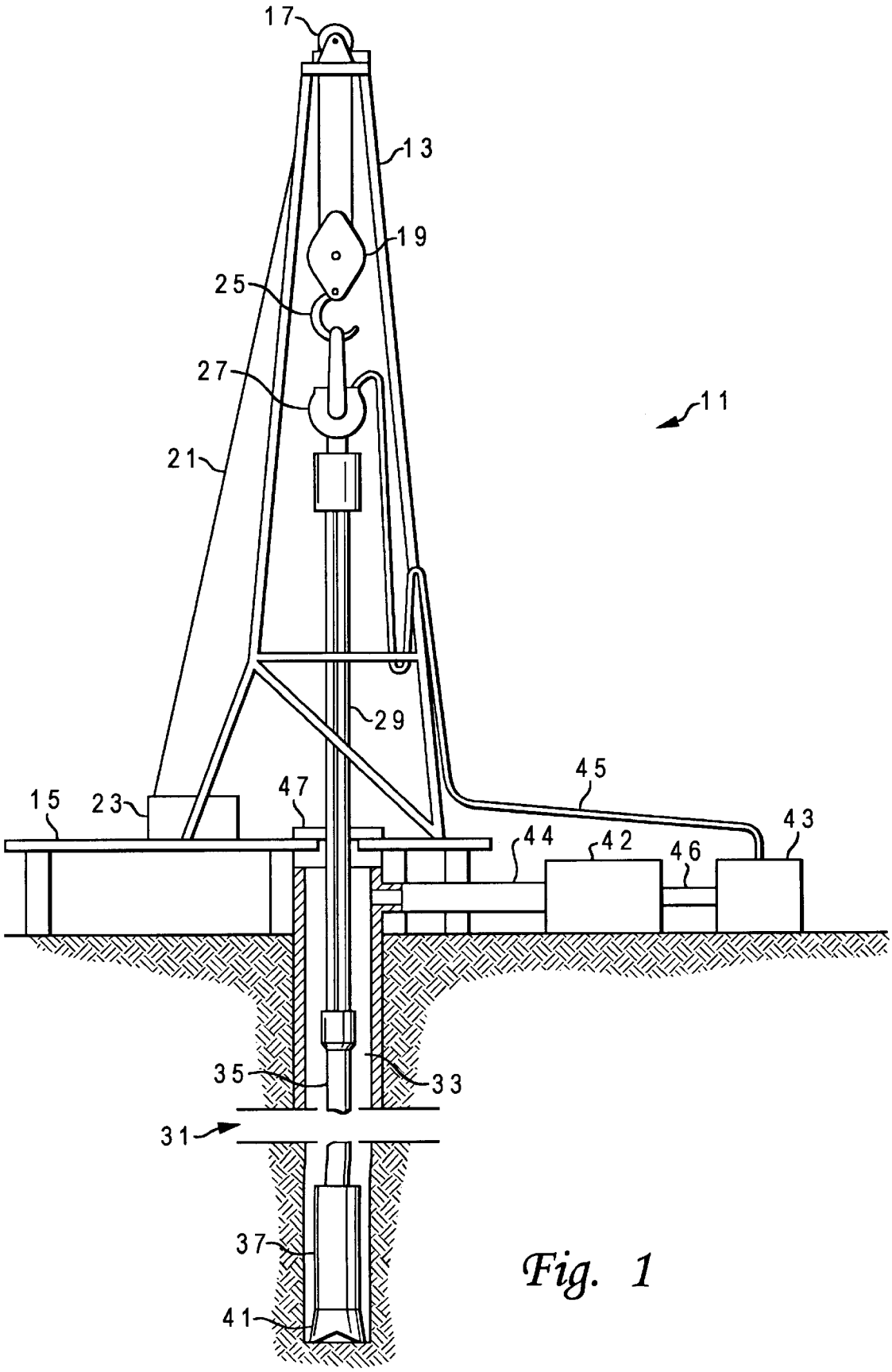
FIG. 1 is representation of a rotary drilling rig.

Referring now to the drawings, and first to FIG. 1, a drilling rig is designated generally by the numeral 11. Rig 11 in FIG. 1 is depicted as a land rig. However, as will be apparent to those skilled in the art, the method and the system of the present invention will find equal application to non-land rigs, such as jack-up rigs, semisubmersibles, drill ships, and the like. Also, although a conventional rotary rig is illustrated, those skilled in the art will recognize that the present invention is also applicable to other drilling technologies, such as top drive, power swivel, down hole motor, coiled tubing units, and the like.

Rig 11 includes a mast 13 that is supported on the ground above a rig floor 15. Rig 11 includes lifting gear, which includes a crown block 17 mounted to mast 13 and a traveling block 19. Crown block 17 and traveling block 19 are interconnected by a cable 21 that is driven by draw works 23 to control the upward and downward movement of traveling block 19. Traveling block 19 carries a hook 25 from which is suspended a swivel 27. Swivel 27 supports a kelly 29, which in turn supports a drill string, designated generally by the numeral 31 in the well bore 33. Drill string 31 includes a plurality of interconnected sections of drill pipe 35 and a bottom hole assembly (BHA) 37, which includes stabilizers, drill collars, measurement while drilling (MWD) instruments, and the like. A rotary drill bit 41 is connected to the bottom of BHA 37.

Drilling fluid is delivered to drill string 31 by mud pumps 43 through a mud hose 45 connected to swivel 27. The drilling fluid is contained in one or more mud tanks 42. Mud tanks 42 receive drilling fluid from well bore 33 through a flow line 44. Drilling mud pump 43 receives drilling fluid from mud tanks 42 through a pump suction line 46.

Drilling is accomplished by applying weight to bit 41 and rotating drill string 31. Drill string 31 is rotated within bore hole 33 by the action of a rotary table 47 rotatably supported on rig floor 15 and in nonrotating engagement with kelly 29. The cuttings produced as bit 41 drills into the earth are carried out of bore hole 33 by drilling mud supplied by pumps 43.

According to the present invention, drilling parameters are monitored by sensors. The sensors measure values that may be displayed directly or used to calculate other values that are displayed. For example, the system includes a hook weight sensor (not shown), which is well known in the art. Hook weight sensors typically comprise digital strain gauges or the like that produce a digital weight value at a convenient sampling rate, which in the preferred embodiment of the present invention is five times per second. Typically, a hook weight sensor is mounted to the static line (not shown) of cable 21 of FIG. 1.

Another important parameter is weight on bit, which can be calculated from the weight on hook. As drill string 31 is lowered into the hole prior to contact of bit 41 with the bottom of the hole, the weight on the hook, as measured by hook weight sensor, is equal to the buoyant weight of string 31 in the drilling mud. Drill string 31 is somewhat elastic. Thus, drill string 31 stretches under its own weight as it is suspended in well bore 33. When bit 41 contacts the bottom of well bore 33, the stretch is reduced and weight is transferred from hook 25 to bit 41. Thus, weight on bit is equal to the difference between the weight of drill string 31 before and after bit 41 contacts the bottom of bore hole 33.

The driller applies weight to bit 41 effectively by controlling the height or position of hook 25 and mast 13. The driller controls the position of hook 25 by paying out cable from draw works 23. The system includes a hook speed sensor (not shown), of the type well known to those skilled in the art. An example of a hook speed sensor is a rotation sensor coupled to crown block 17. A rotation sensor produces a digital indication of the magnitude and direction of rotation of crown block 17 or draw works 23 at the desired sampling rate. The direction and linear travel of cable 21 can be calculated from the output of the hook position sensor. The speed of travel and position of traveling block 19 and hook 25 can be easily calculated based upon the linear speed of cable 21 and the number of cables between crown block 17 and traveling block 19. In the manner well known to those skilled in the art, the rate of penetration of bit 41 may be computed based upon the rate of travel of hook 25 and the time rate of change of hook weight.

The driller can also affect or control the rate of penetration based upon the speed of rotation of rotary table 47 and the pressure of mud pumps 43. Accordingly, the system of the present invention includes a rotary table rpm sensor (not shown) and a mud pump pressure sensor (not shown), each of which outputs a digital value at the desired sampling rate.

In addition to a rotary speed sensor, the system of the present invention includes a rotary torque sensor (not shown), which measures the amount of torque applied to drill string 35 during rotation. In electric rigs, the torque is indicated by measuring the amount of current drawn by the motor that drives rotary table 47. In mechanical rigs, the rotary torque sensor senses the tension in the rotary table drive chain. Rotary torque and rotary speed give an indication of down hole conditions.

In addition to a pump pressure sensor, the system of the present invention includes sensors (not shown) for measuring mud pump speed in strokes per minute, from which the flow rate of drilling fluids into the drill string can be calculated easily. Additionally, the system of the present invention includes sensors (not shown) for measuring other parameters with respect to the drilling fluid system. For example, the system of the present invention includes sensors for measuring the volume of fluid in mud tank 42 and the rate of flow into and out of mud tank 42. Also, the system of the present invention includes sensors (not shown) for measuring mud gas, flow line temperature, and mud density. Preferably, the system includes sensors that measure various parameters of the well bore trajectory and/or petrophysical properties of the geologic formations, as well as downhole operating parameters.

Figure 2:
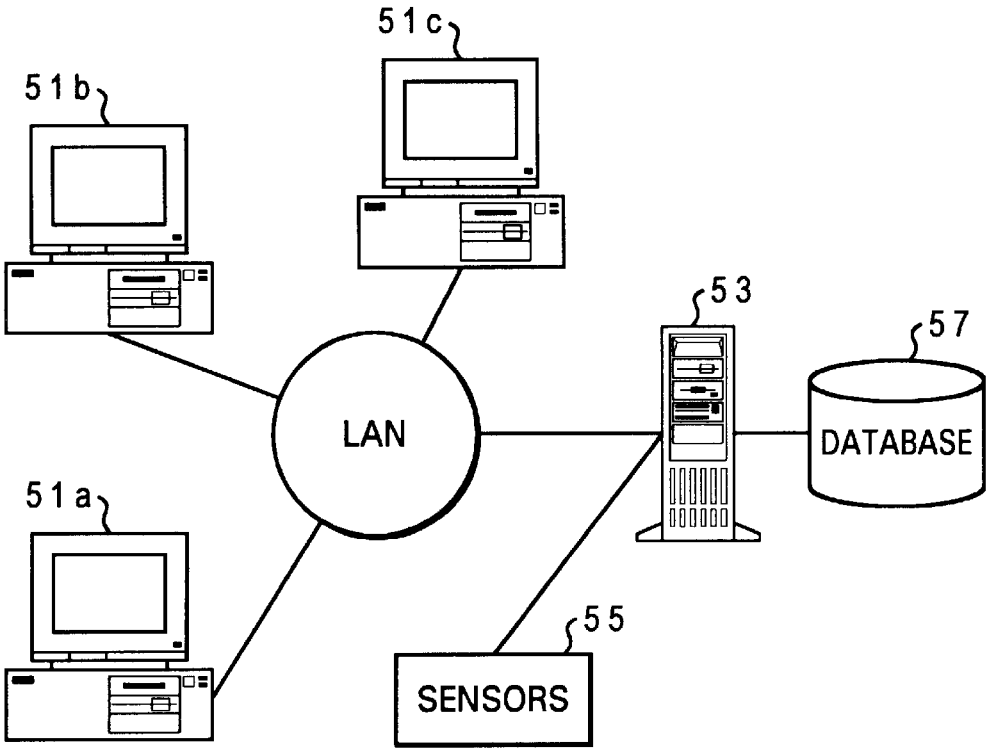
FIG. 2 is a block diagram of a system according to the present invention.

Referring now to FIG. 2, there is shown a block diagram of a local area network according to the present invention. The local area network includes a plurality of personal computer work stations 51 that are interconnected by a suitable network. While in FIG. 2, three work stations are shown, it will be apparent that the system may include more or fewer work stations. A server 53 is connected to receive input from sensors indicated generally at 55. Server 53 is adapted to sample the values of sensors 55 at a convenient sampling rate, which in the preferred embodiment is five times per second. The values sampled by server 53 are stored in a database 57. According to the present invention, and as will be explained in detail hereinafter, each personal computer work station 51 may access database 57 to obtain a configurable real time display of drilling parameters stored in data base 57.

Figure 3:
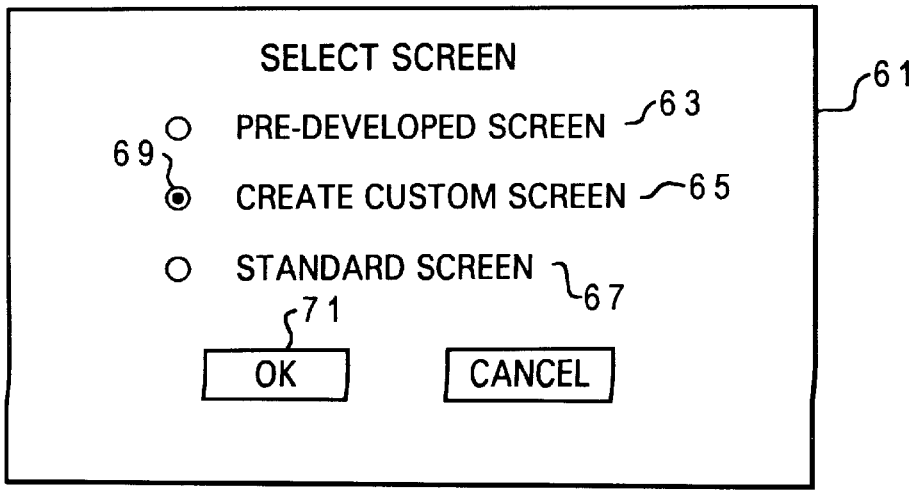
FIG. 3 is a representation of a SELECT SCREEN screen according to the present invention.

The present invention is preferably implemented in a graphical operating environment such as Windows NT, or the like. In FIGS. 3–9, there are shown various screens according to the present invention. Referring first to FIG. 3, a SELECT SCREEN screen is indicated at 61. Screen 61 includes as menu choices predeveloped screen 63, create custom screen 65, and standard screen choice 67. Predeveloped screens are screens that a user has developed previously using create custom screen choice 65. Standard screens are provided with the system. The user selects a screen by clicking a radio button 69. After the user has selected the screen, the user enters his or her selection by clicking an OK button 71.

Figure 7:
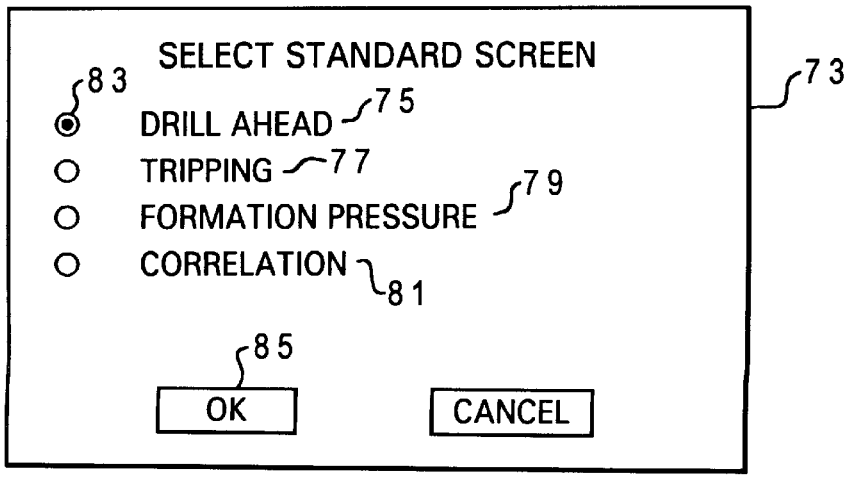
FIG. 7 is a representation of a SELECT STANDARD SCREEN screen according to the present invention.

If the user selects standard screen choice 67, the system displays the select standard screen menu, which is shown in FIG. 7. Referring to FIG. 7, select standard screen screen is indicated at 73. Screen 73 includes various standard screens, including drill ahead 75, tripping 77, pressure 79, and correlation 81. The user can choose a standard screen by clicking on a radio button 83 and on OK button 85.

Figure 8:
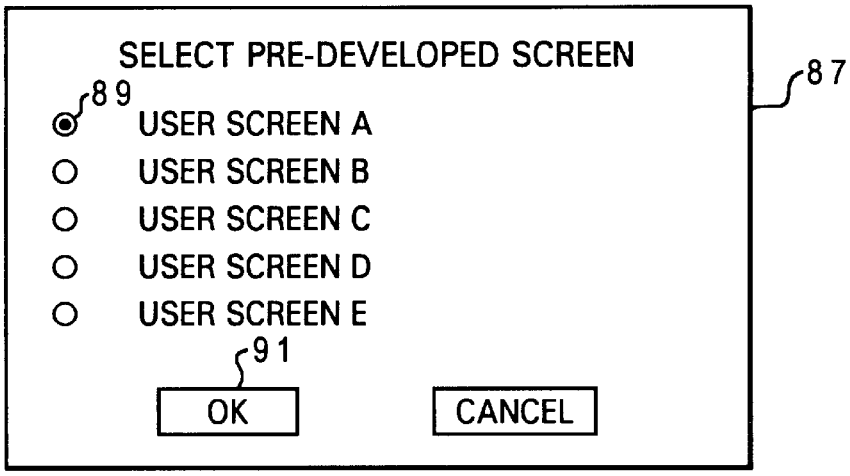
FIG. 8 is a representation of a SELECT PRE-DEVELOPED SCREEN screen according to the present invention.
Figure 11A:
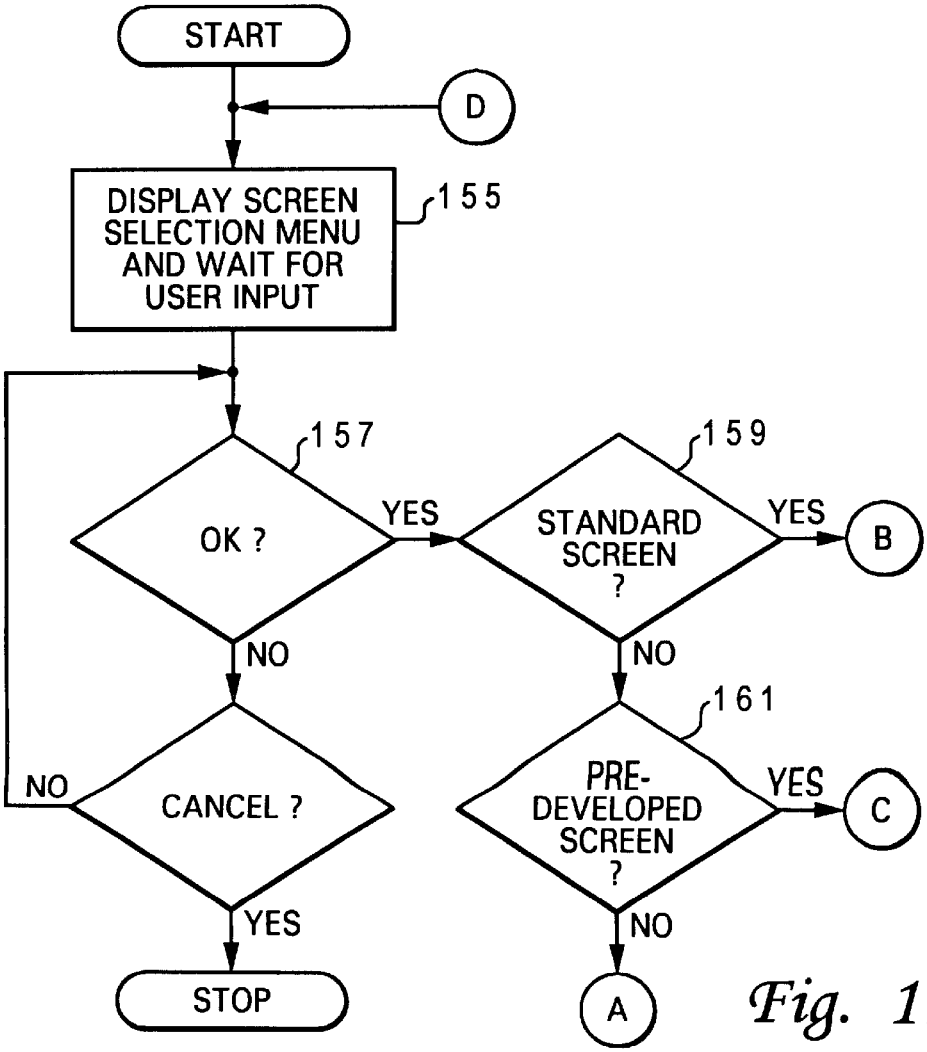
FIGS. 11A–11E comprise a flowchart of SELECT SCREEN processing of FIG. 10.

Returning to FIG. 3, if the user selects predeveloped screen choice 63, then the system displays a select predeveloped screen menu 87, shown in FIG. 8. Predeveloped screens are associated with the user that developed the screen. As will be described in detail hereinafter, when the user develops a screen, the user is prompted to save the screen and to give the screen a name. In FIG. 8, the screens are identified simply for purposes of illustration as user screens A–E. The user selects a predeveloped screen by clicking on a radio button 89 and an okay button 91.

Figure 4:
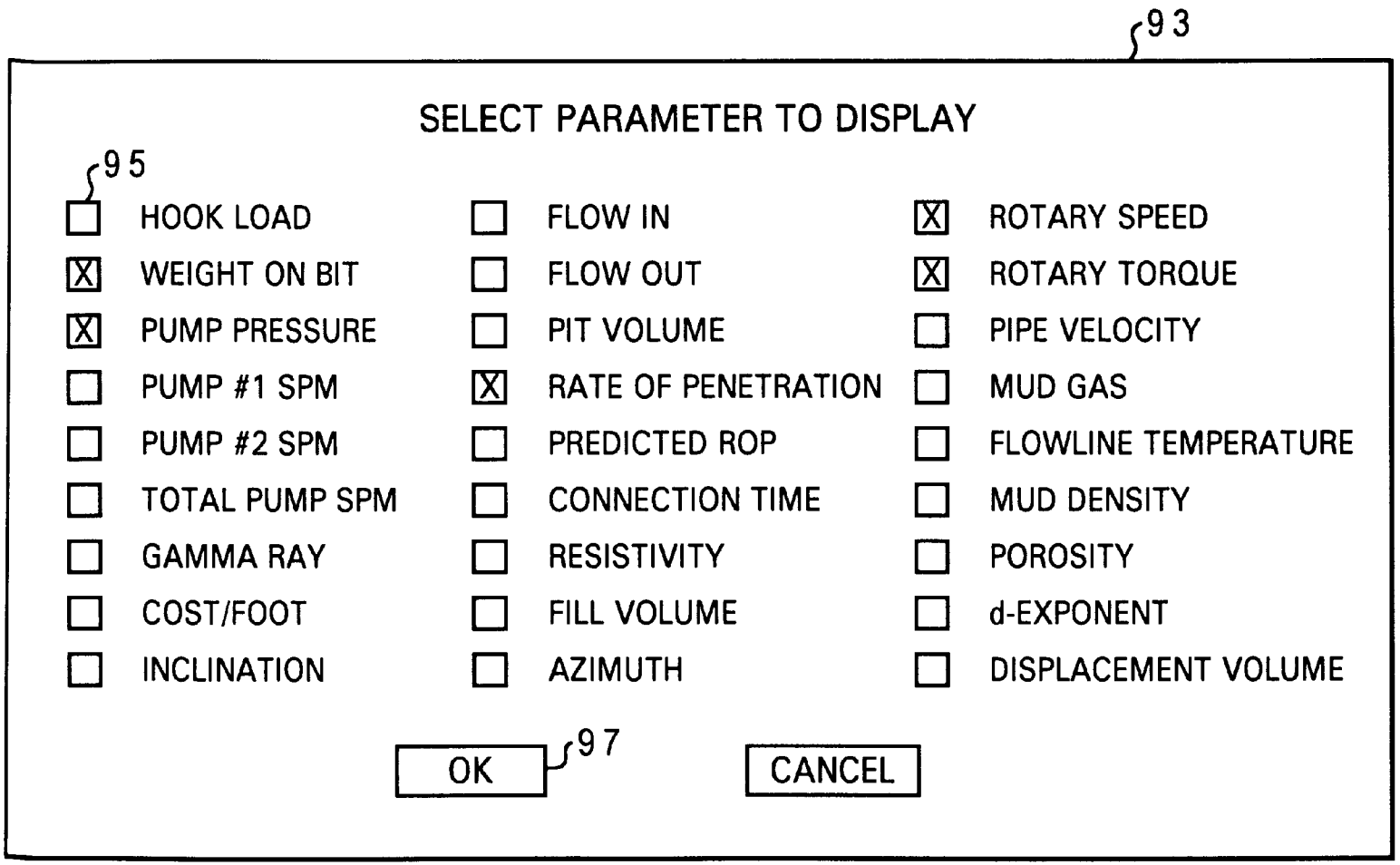
FIG. 4 is a representation of a SELECT PARAMETERS TO DISPLAY screen according to the present invention.

Referring again to FIG. 3, if the user selects create custom screen choice 65, then the system displays a select parameter to display screen, which is designated by the numeral 93 in FIG. 4. Screen 93 displays a list of all parameters that are monitored according to the present invention. Screen 93 includes a check box 95 with which a user can select the parameters to be displayed. In the preferred embodiment, the user can select up to five parameters for display. After the user has selected the parameters to display by checking the appropriate check boxes 95, the user proceeds to the next screen by clicking on OK button 97.

Figure 5:
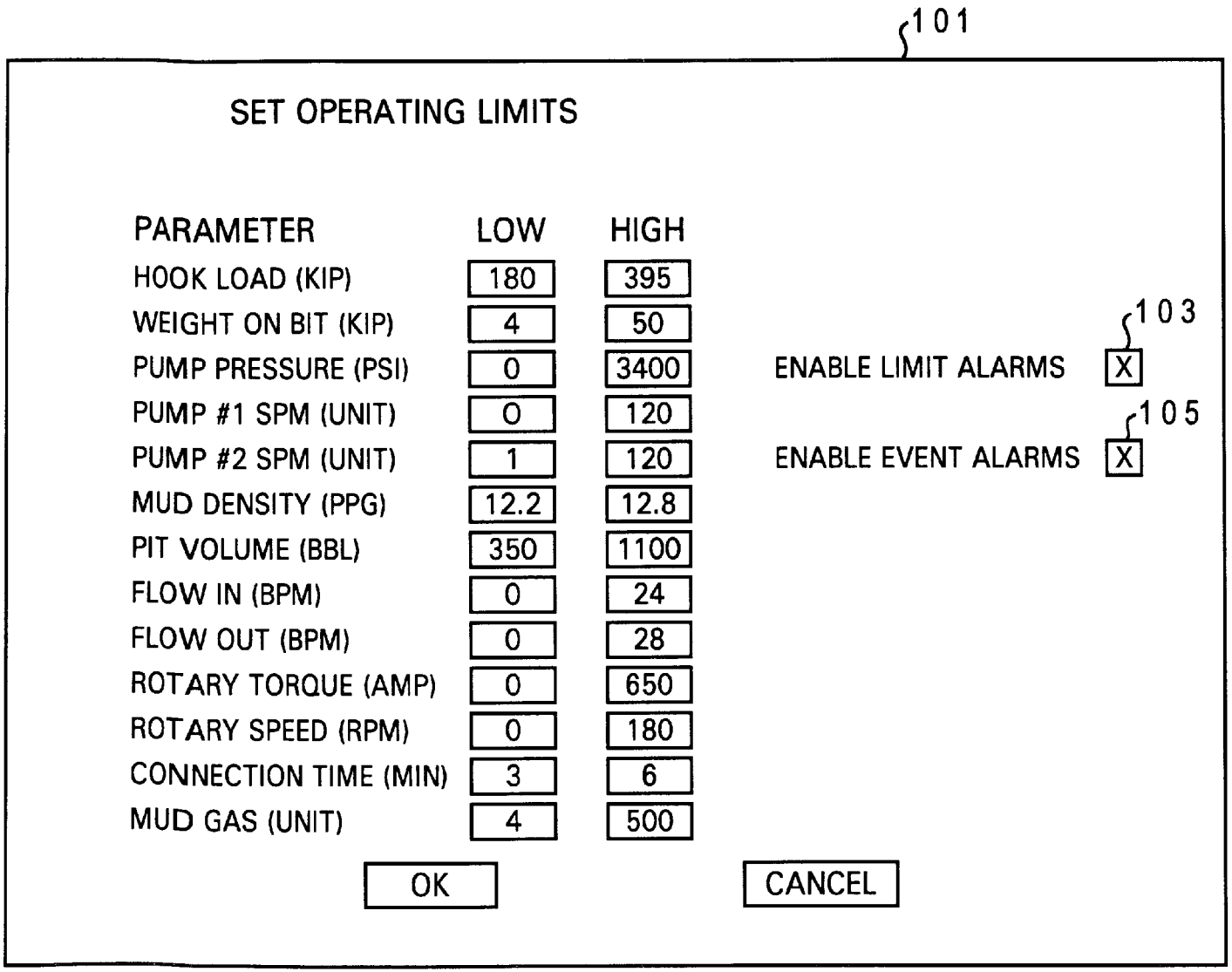
FIG. 5 is a representation of a SET OPERATING LIMITS screen according to the present invention.

Referring now to FIG. 5, after the user has clicked the okay check button in the screens of FIGS. 4, 7, or 8, then the system displays a set operating limits screen indicated at 101. Operating limits may be set for various parameters in terms of a high limit and a low limit. Operating limits screen 101 is initially populated with default values for the operating parameters. However, a user can change the operating limits if he or she desires by typing over the default values. According to the present invention, the user may enable operating limit alarms by checking a check box 103. If the user has enabled the limit alarms, then the system will provide an audio or visual alarm if any one of the parameters goes outside the limits.

The user may also enable event alarms by checking a check box 105. An event alarm is actuated when the system of the present invention detects a drilling event signature. Drilling event signatures are combinations of trends in certain parameters. For example, a drilling break is indicated by increasing rate of penetration together with stable or decreasing weight on bit. A lost circulation event is indicated by the combination of decreasing flow out, pit level, and pump pressure. As another example, bit balling is indicated by a combination of decreasing rate of penetration and rotary torque. If the user has enabled event alarms, then the system will provide an audible or visual alarm whenever the system detects an event signature.

Figure 6:
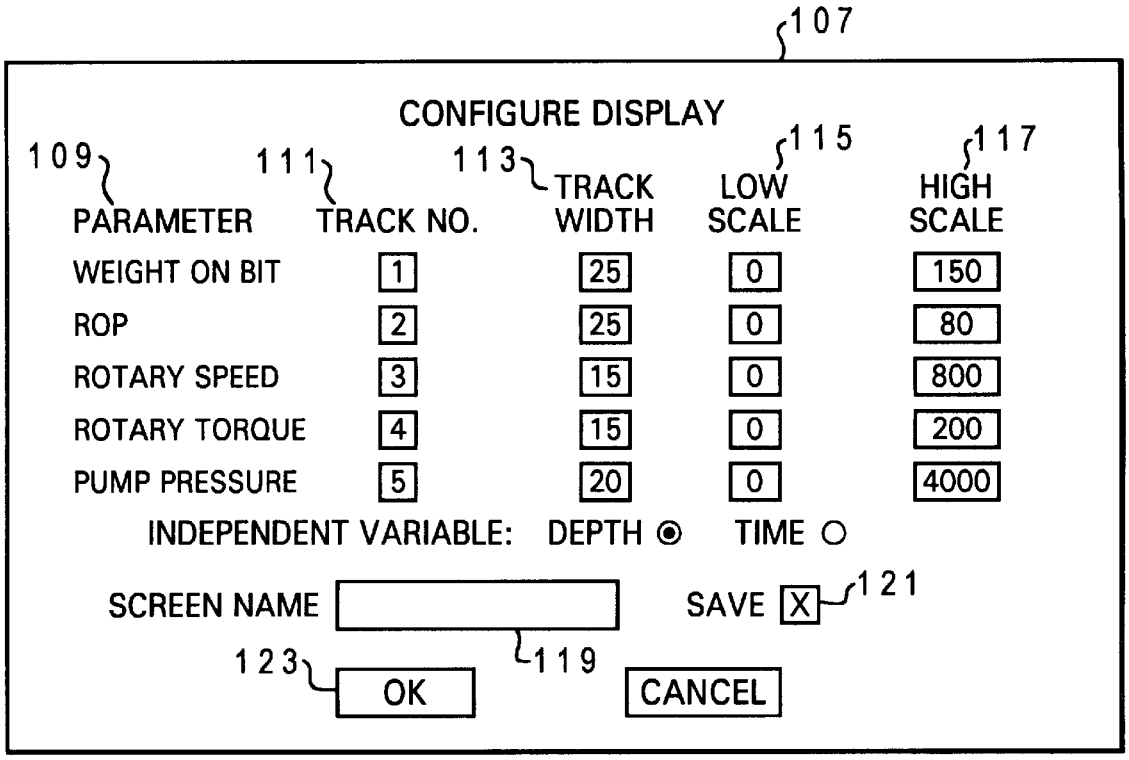
FIG. 6 is a representation of a CONFIGURE DISPLAY screen according to the present invention.

The present invention enables a user to configure a custom display. Referring to FIG. 6, a configure display screen is designated by the numeral 107. The parameters to be displayed are listed in a column 109. The user can order the display of parameters left to right across the screen by selecting a track number from a column 111. The user can select a track width in terms of percentage of total width of the display by entering values in appropriate entry boxes in a track width column 113. The user can set low scale and high scale values by entering numbers into columns 115 and 117, respectively. The user can select the independent variable for the display to be either depth or time by selecting the appropriate radio button. The user can name the screen by entering a name into a box 119. The user can save the screen as a predeveloped screen by checking check box 121. After the user has configured and named the display, and either checked or not checked box 121, the user can click on okay button 123 to display the selected screen.

Figure 9:
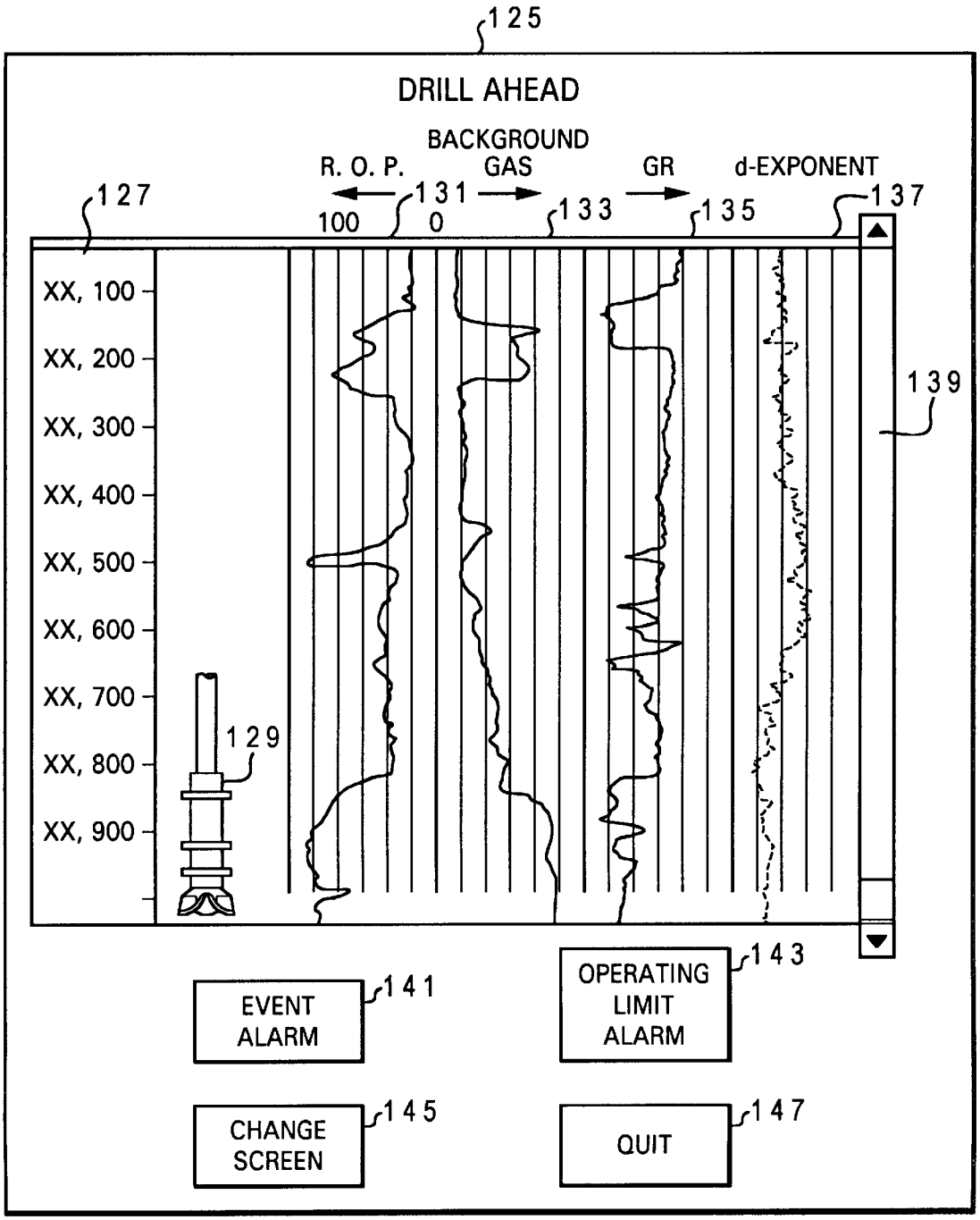
FIG. 9 is a representation of a DRILL AHEAD screen according to the present invention.

Referring now to FIG. 9, there is shown an example of a drill ahead screen, which is designated by the numeral 125. All screens according to the present invention are generally of the type illustrated in FIG. 9. Generally, the screens according to the present invention provide a graphical depiction of selected parameters correlated with respect to well bore depth. In FIG. 9, depth is indicated by a column 127, and a graphic of a bottom hole assembly 129 is provided to indicate the depth of the actual bottom hole assembly in the well bore. In the drill ahead screen of FIG. 9, rate of penetration, background gas, gamma ray, and d-exponent are indicated graphically in respective columns 131–137. A scroll bar 139 is provided so that the user may scroll up and down to view the parameters at various depths. The user can observe trends in various parameters in real time. Screen 125 may also include a visual event alarm indicator 141 and an operating limit alarm indicator 143. If an event or operating limit alarm situation occurs, then the alarm will be indicated visually. The system may also include an audible alarm to alert the user to the occurrence of an event condition. The user can change screens by clicking on a change screen button 145. If the user clicks on change screen button 145, the user is taken back to the screen of FIG. 3. A quit button 147 is provided so that the user can terminate the display according to the present invention.

Figure 10:
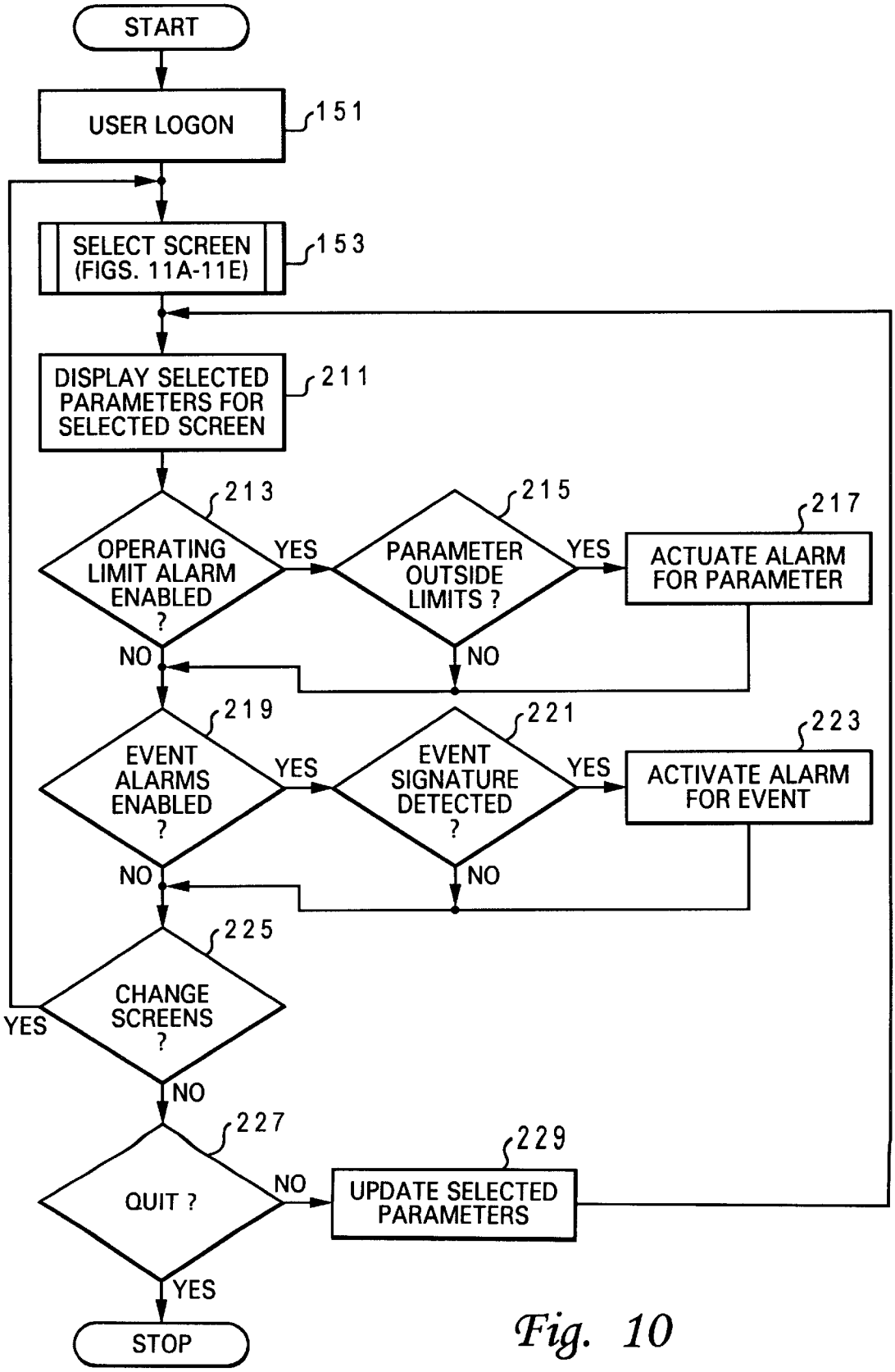
FIG. 10 is a high level flowchart of processing according to the method of the present invention.

Referring now to FIG. 10, there is shown a high level flow chart of processing according to the present invention. Preferably, the system includes a user log on routine, indicated generally at block 151, in which the user logs on with a user I.D. and password. After log on, the system executes a select screen routine, indicated generally at block 153, and shown in detail with respect to FIGS. 11A–11E.

Referring now to FIGS. 11A–11E, there is shown select screen processing. The system displays the screen selection menu and waits for user input at block 155. If at decision block 157, the user selects the "OK" button, then the system tests, at decision block 159, if the user has checked the "standard screen" check box. If so, processing continues at FIG. 11D. If, at decision block 161, the user has checked the "predeveloped screen" check box, then processing continues at FIG. 11E. If the user has not checked the "standard screen" check box or the "predeveloped screen" check box, then, by default, the user has selected the custom screen check box and processing continues at FIG. 11B.

Figure 11B:
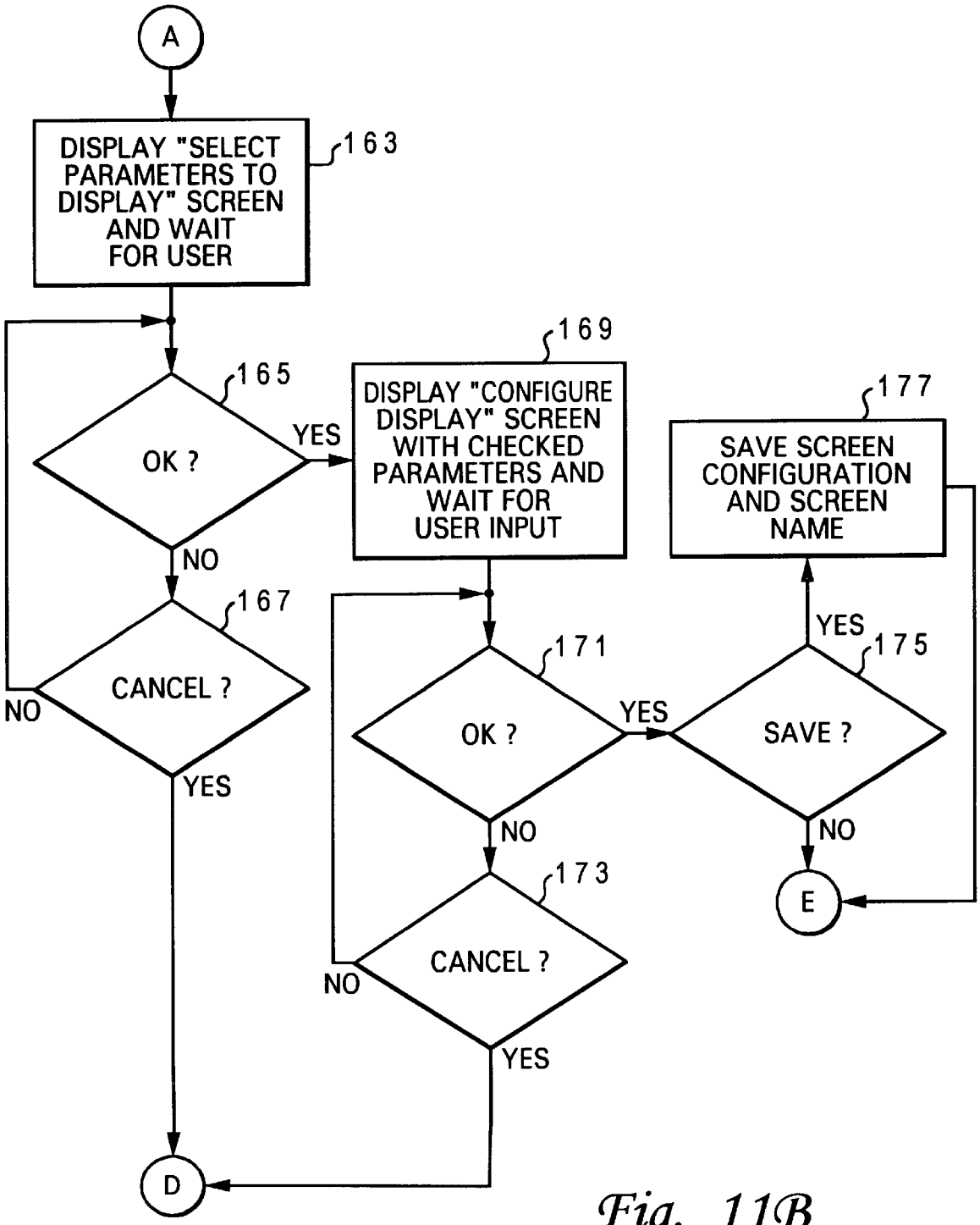

Referring now to FIG. 11B, the system displays the "select parameters to display" screen and waits for user input at block 163. If, at decision block 165, the user input is not the "OK" button, then the system tests, at decision block 167, if the "cancel" button has been clicked. If so, then processing returns to block 155 of FIG. 11A. If, at decision block 165, the user clicks on the "OK" button, then the system displays the "configure display" screen with checked parameters and waits for user input at block 169. If, at decision block 171, the user input is not "OK", then the system determines, at decision block 173, if the user input is canceled. If so, then processing returns to block 155 of FIG. 11A. If, at decision block 171, the user input is "OK", then the system tests, at decision block 175, if the user has checked the "save" check box. If so, then the system saves the screen configuration and screen name at block 177 and processing continues at FIG. 11C.

Figure 11C:
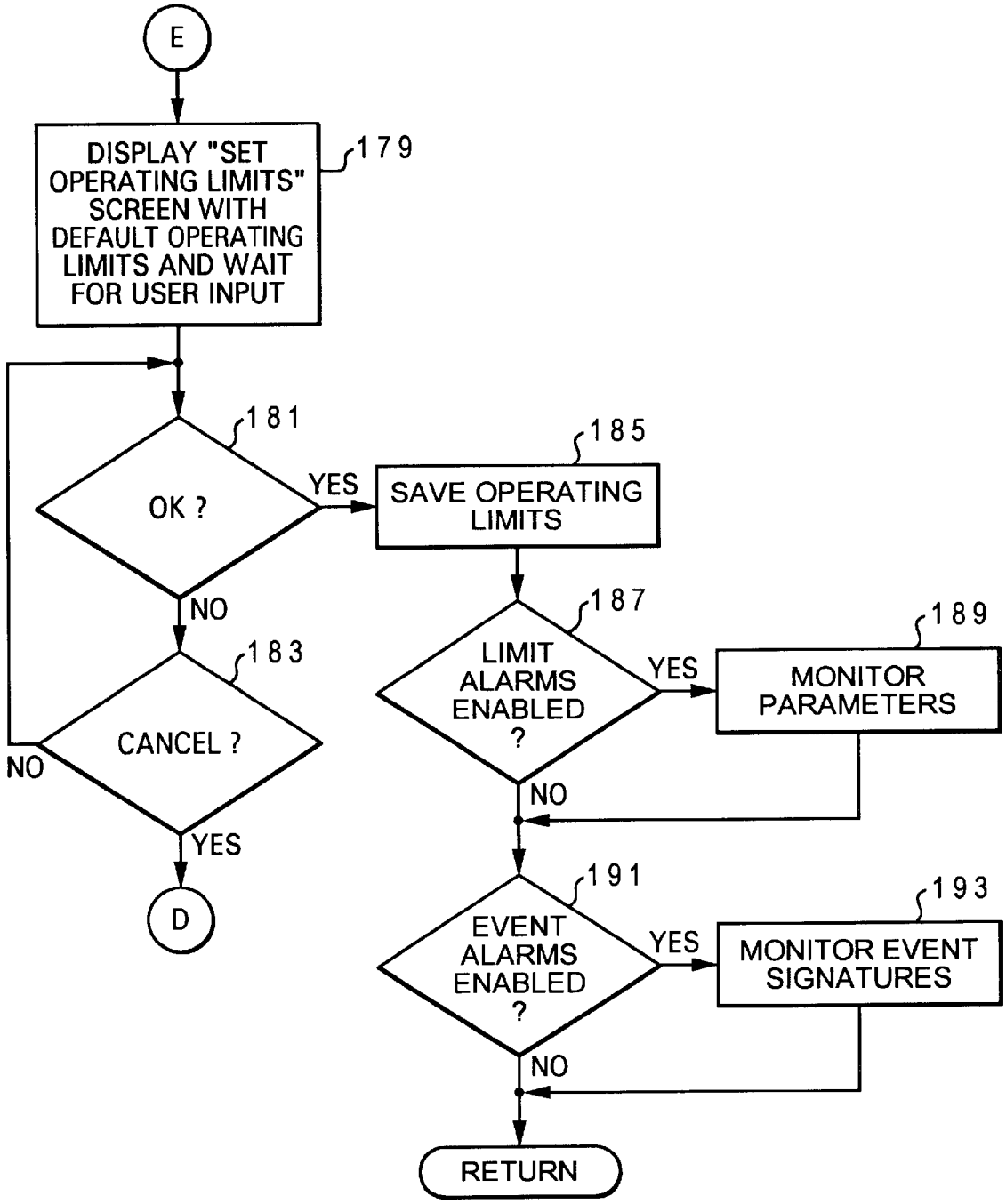

Referring now to FIG. 11C, the system displays the "set operating limits" screen with default operating limits and waits for user input, at block 179. If, at decision block 181, the user input is not "OK", then the system tests, at decision block 183, if the user input is "cancel." If so, then processing continues at block 155 of FIG. 11A. If, at decision block 181, the user input is "OK", then the system saves the operating limits at block 185 and tests, at decision block 187, if alarm limits are enabled. If so, then the system monitors the parameters at block 189. The system tests, at decision block 191 if event alarms are enabled. If so, then the system monitors event signatures at block 193 and processing returns to FIG. 10.

Figure 11E:
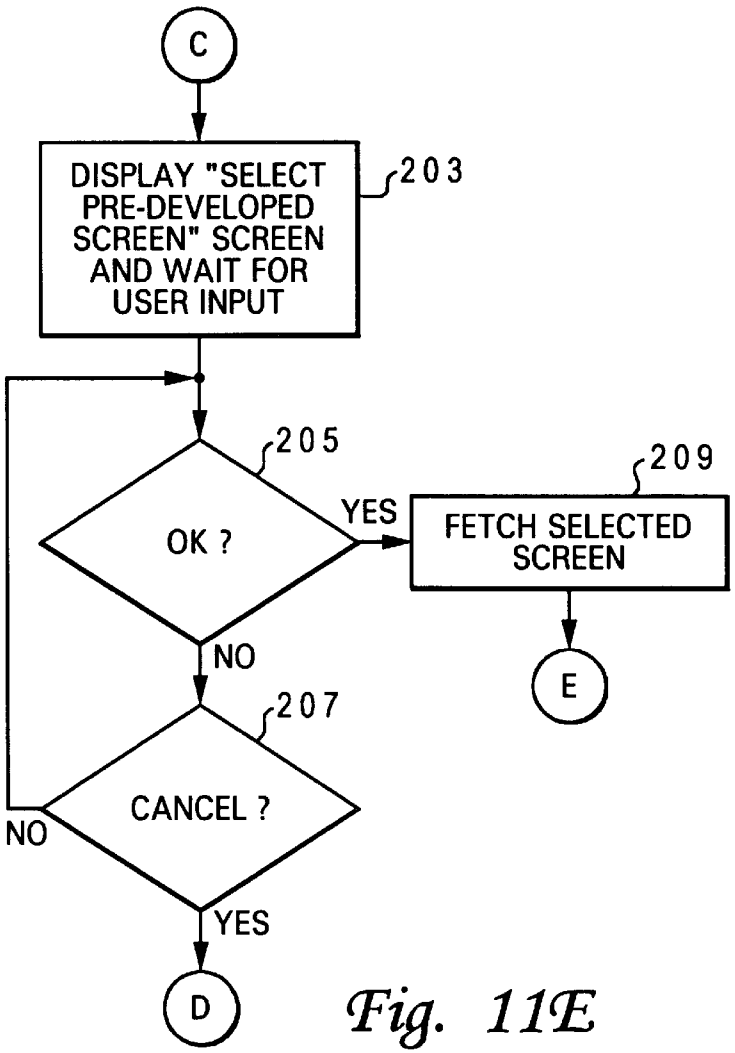
Figure 11D:
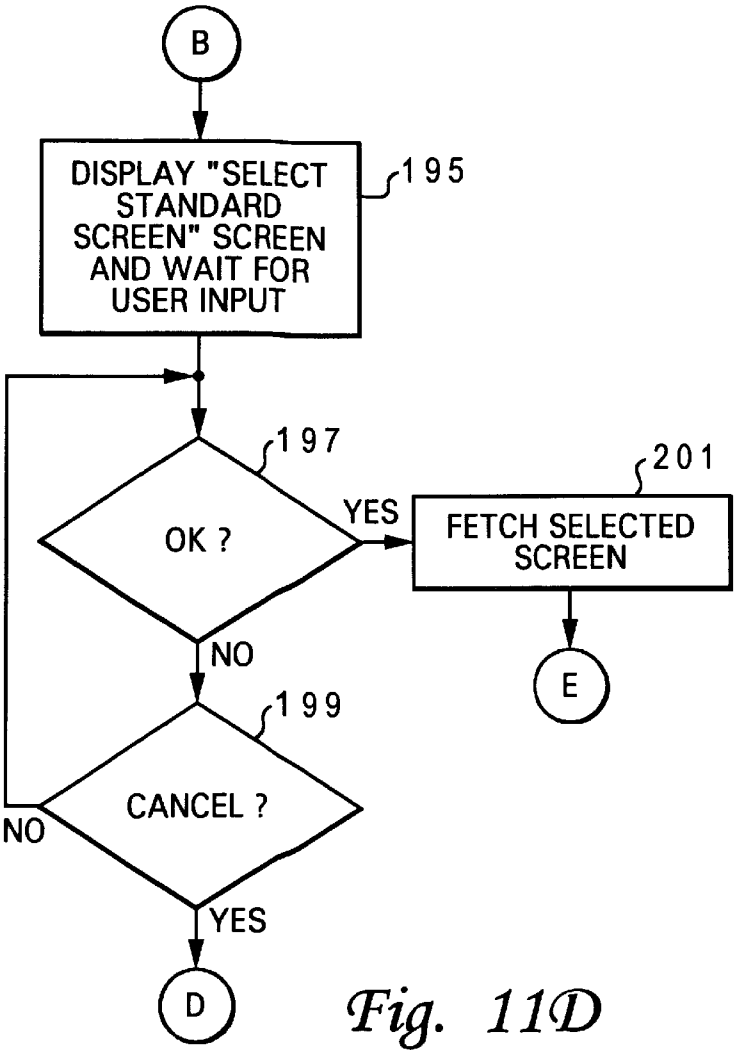

Referring now to FIG. 11D, there is shown a flow chart of standard screen processing. The system displays the "select standard screen" screen and waits for user input at block 195. Upon receipt of user input, the system tests, at decision block 197, if the user input is "OK." If not, the system tests, at decision block 199 if the user input is "cancel." If so, processing continues at block 155 of FIG. 11A. If, at decision block 197, the user input is "OK", then the system fetches the selected screen at block 201 and processing continues at FIG. 11C.

Referring now to FIG. 11E, there is shown predeveloped screen processing. The system displays the "select predeveloped screen" screen and waits for user input at block 203. If, at decision block 205, the user input is not "OK", then the system tests, at decision block 207, if the user input is "canceled." If so, then processing continues at block 155 of FIG. 11E. If, at decision block 205, the user input is "OK", then the system fetches the selected screen, at block 209, and processing continues at FIG. 11C.

Referring again to FIG. 10, after the system has performed select screen processing, indicated generally at block 153, then the system displays the selected parameters for the selected screen, at block 211. If, at decision block 213, operating limit alarms are enabled, then the system tests, at decision block 215, if any parameter is outside the limits. If so, then the system actuates an alarm for the parameter, at block 217. If, at decision block 219, event alarms are enabled, then the system tests, at decision block 221 if an event alarm is detected. If so, then the system activates an alarm for the event at block 223.

After alarm processing, the system tests, at decision block 225, if the user has selected the "change screens" button. If so, processing returns to select screen processing, at block 153. If the user has not selected the change screens button at decision block 225, the system tests, at decision block 227, if the user has selected the "quit" button. If not, the system updates the selected parameters at block 229 and processing returns to block 211. If, at decision block 227, the user has selected the "quit" button, then processing ends.

From the foregoing, it may be seen that the present invention provides instant real-time information to drilling personnel. The multi-parameter information enables personnel to spot trends and to foresee problems before they occur. The present invention thus enables personnel to take prompt action to avoid costly or disastrous conditions.

What is claimed is:

1. A method of monitoring drilling parameters in real time, which comprises the computer implemented steps of:

displaying a list of drilling parameters;

in response to user selection of a set of drilling parameters from said list of drilling parameters, simultaneously displaying a graphical representation of each parameter of said set of drilling parameters.

2. The method as claimed in claim 1, including the computer implemented steps of:

prompting said user to enable operating limit alarms for at least some of said drilling parameters of said list; and, in response to enablement of said operating limit alarms, monitoring said at least some of said drilling parameters for operating limit alarm conditions.

3. The method as claimed in claim 2, including the computer implemented step of:

in response to detection of an operating limit alarm condition, producing an alarm.

4. The method as claimed in claim 2, including the computer implemented step of:

prompting said user to set operating limits for said at least some of said drilling parameters.

5. The method as claimed in claim 1, including the computer implemented steps of:

prompting said user to enable drilling event alarms; and, in response to enablement of said drilling event alarms, monitoring at least some of said drilling parameters for an occurrence of a drilling event signature.

6. The method as claimed in claim 5, including the computer implemented step of:

in response to detection of a drilling event signature, producing an alarm.

7. The method as claimed in claim 1, including the computer implemented steps of:

prompting said user to configure a display screen for displaying said graphical representation of each parameter of said set of drilling parameters; and, displaying said graphical representation of each parameter of said set of drilling parameters in accordance with configuration by said user.

8. The method as claimed in claim 7, wherein said step of prompting said user to configure said display screen includes the computer implemented steps of:

prompting said user to define an order of display of said selected drilling parameters.

9. The method as claimed in claim 7, wherein said step of prompting said user to configure said display screen includes the computer implemented steps of:

prompting said user to define a track width for each of said selected drilling parameters.

10. The method as claimed in claim 7, wherein said step of prompting said user to configure said display screen includes the computer implemented steps of:

prompting said user to specify an independent variable for the display of said selected drilling parameters.

11. The method as claimed in claim 10, wherein said independent variable is time.

12. The method as claimed in claim 10, wherein said independent variable is depth.

13. The method as claimed in claim 1, including the computer implemented steps:

prompting said user to save a display screen for displaying said graphical representation of each parameter of said set of drilling parameters; and, saving said display screen for displaying said graphical representation of each parameter of said set of drilling parameters.

14. The method as claimed in claim 13, including the computer implemented steps of:

displaying a list of display screens previously saved by said user; and, in response to selection of a previously saved screen, displaying said selected screen.

15. A method of monitoring drilling parameters in real time, which comprises the computer implemented step of:

prompting a user to select a display screen from a list including a pre-developed screen choice, a custom screen choice, and a standard screen choice, wherein each of said screens is adapted to display simultaneous real time graphical representations of a set of drilling parameters.

16. The method as claimed in claim 15, including the computer implemented steps of:

prompting said user to enable operating limit alarms for a second set of drilling parameters; and, in response to enablement of said operating limit alarms, monitoring said second set of drilling parameters for operating limit alarm conditions.

17. The method as claimed in claim 16, including the computer implemented step of:

in response to detection of an operating limit alarm condition, producing an alarm.

18. The method as claimed in claim 16, including the computer implemented step of:

prompting said user to set operating limits for said second set of drilling parameters.

19. The method as claimed in claim 15, including the computer implemented steps of:

prompting said user to enable drilling event alarms; and, in response to enablement of said drilling event alarms, monitoring at least some of said drilling parameters for an occurrence of a drilling event signature.

20. The method as claimed in claim 19, including the computer implemented step of:

in response to detection of a drilling event signature, producing an alarm.

21. The method as claimed in claim 15, including the computer implemented steps of:

in response to selection of said custom screen choice, displaying a list of drilling parameters; and, prompting said user to select a set of drilling parameters from said list of drilling parameters.

22. The method as claimed in claim 21, including the computer implemented steps of:

in response to selection by said user of a set of drilling parameters, prompting said user to configure a display screen for displaying said graphical representation of each parameter of the selected set of drilling parameters; and, displaying said graphical representation of each parameter of said selected set of drilling parameters in accordance with configuration by said user.

23. The method as claimed in claim 21, including the computer implemented steps:

in response to selection by said user of a set of drilling parameters, prompting said user to save a display screen for displaying said graphical representation of each parameter of said selected set of drilling parameters; and, saving said display screen for displaying said graphical representation of each parameter of said selected set of drilling parameters as a pre-developed screen.

24. The method as claimed in claim 15, including the computer implemented step of:

in response to user selection of said predeveloped screen choice, displaying a list of predeveloped screens.

25. The method as claimed in claim 15, including the computer implemented step of:

in response to user selection of said standard screen choice, displaying a list of standard screens.

* * * * *